US007890030B2

(12) United States Patent
Innami et al.

(10) Patent No.: US 7,890,030 B2
(45) Date of Patent: Feb. 15, 2011

(54) MAGNETIC ROLLER, DEVELOPER CARRIER, DEVELOPING DEVICE, PROCESS CARTRIDGE, AND IMAGE FORMING APPARATUS

(75) Inventors: Takashi Innami, Atsugi (JP); Kyohta Koetsuka, Fujisawa (JP); Yoshiyuki Takano, Hachioji (JP); Tadaaki Hattori, Hadano (JP); Noriyuki Kamiya, Yamato (JP); Masayuki Ohsawa, Atsugi (JP); Mieko Terashima, Isehara (JP); Rei Suzuki, Atsugi (JP); Hiroya Abe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/397,712

(22) Filed: Mar. 4, 2009

(65) Prior Publication Data

US 2009/0232563 A1 Sep. 17, 2009

(30) Foreign Application Priority Data

Mar. 13, 2008 (JP) ..... 2008-063707

(51) Int. Cl.
*G03G 15/09* (2006.01)

(52) U.S. Cl. ..... 399/277

(58) Field of Classification Search ..... 399/277, 399/267; 492/8, 18, 47
See application file for complete search history.

(56) References Cited

U.S. PATENT DOCUMENTS

| | | | | |
|---|---|---|---|---|
| 6,061,541 | A * | 5/2000 | Bessette | 399/277 |
| 6,850,140 | B1 * | 2/2005 | Gleckner | 399/277 X |
| 2008/0213007 | A1 | 9/2008 | Takano et al. | 399/277 |
| 2008/0232865 | A1 | 9/2008 | Terashima et al. | 399/286 |
| 2008/0298849 | A1 | 12/2008 | Imamura et al. | 399/277 |

FOREIGN PATENT DOCUMENTS

| | | |
|---|---|---|
| JP | 11-242391 | 9/1999 |
| JP | 2000-114031 | 4/2000 |
| JP | 2002-372867 | 12/2002 |
| JP | 2006-71732 | 3/2006 |
| JP | 2007-171297 | 7/2007 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A magnetic roller includes a cylindrical magnetic field generation part (140), a cylindrical support part (143) that contacts both of the edges of the magnetic field generation part (140), further has a smaller diameter than the magnetic field generation part (140), and which is installed upon a common axis thereof as an axis of the cylindrical support part (143), and a depression part (140*c*) that is installed upon an obverse surface of the cylindrical magnetic field generation part (140), extends in a direction of the axis of the magnetic field generation part (140), and wherein a lengthwise magnet formation is inserted. The cylindrical magnetic field generation part (140) is configured of a main body portion (140*a*), which is installed upon a central portion of the cylindrical magnetic field generation part (140), and a reinforcing portion (140*b*), which is installed upon each of both ends, wherein the depression part (140*c*) is installed across the main body portion (140*a*) of the magnetic field generation part (140) overall, and the reinforcing portion (140*b*) is installed between an end of the depression part (140*c*) and an end of the support part.

6 Claims, 4 Drawing Sheets

MAGNETIC ROLLER, DEVELOPER CARRIER, DEVELOPING DEVICE, PROCESS CARTRIDGE, AND IMAGE FORMING APPARATUS

CROSS-REFERENCE TO THE RELATED APPLICATION

The present application is based on and claims the priority benefit of Japanese Patent Application No. 2008-063707, filed on Mar. 13, 2008, the disclosure whereof is incorporated herein by reference in its entirety.

BACKGROUND OF THE INVENTION

1. Field of the Invention

The present invention relates to a magnetic roller that is contained within a hollow non-magnetic body, i.e., a development sleeve, and which rotates relative to the hollow non-magnetic body, in order to convey a developer upon the hollow non-magnetic body to a latent image carrier, a developer carrier, i.e., a development roller, including the magnetic roller, a developing device including the developer carrier, a process cartridge including the developing device, and an image forming apparatus including the process cartridge.

2. Description of the Related Art

Typically, in an image forming apparatus of an electrophotographic system, an electrostatic latent image is formed that corresponds to image information upon a latent image carrier, which is formed from a photoconductive drum or a photoconductive belt, and thereafter, a developing operation is executed by way of a developing device upon the electrostatic latent image, and thereby a visible image is obtained.

In a developing process by way of the electro-photographic system thereupon, a developing system by way of a magnetic brush is widely used. When employing a two-component developer that is formed from a toner and a magnetic particle, with the developing system that is implemented by way of the magnetic brush, the magnetic brush is formed by causing the two-component developer to adhere magnetically to an external circumference of the developer carrier, and the development is performed upon a development region, i.e., a region whereupon an electrical field whereupon an image development is possible is maintained between a developer carrier and a latent image carrier, by causing the toner to be supplied and applied selectively to the latent image upon the latent image carrier that is positioned opposite to the magnetic brush, by way of an electrical field that is present between the latent image carrier whereupon the electrostatic latent image is formed, and a sleeve whereupon an electrical bias is impressed.

In recent years, an interest has arisen with regard to miniaturizing the developing device, and a necessity has commensurately arisen for miniaturizing a developing roller thereupon. It is difficult however, in practical terms, to achieve a strong magnetism characteristic of a primary pole portion of the development roller, which is typically not less than 100 millitesla (mT) upon the development roller, as well as a high precision thereof, however, with a material, a roller configuration, and a manufacturing method thereof, that has been conventionally employed therewith.

It is difficult to satisfy the requirement thereof with a ferrite class of magnet that is typically conventionally employed as a magnetic material therewith, and thus, a necessity has arisen for employing a rare earth magnet, such as a neodymium-iron-boron (NeFeB) magnet, upon the primary pole portion of the development roller thereof. The rare earth magnet is expensive, and thus, as a practical configuration of the development roller, i.e., a magnetic roller, a configuration would be desirable that employs the rare earth magnet only upon the primary pole portion, a high magnetism characteristic is required, and to use the ferrite type of magnet upon another pole thereof. More specifically, it would be possible to minimize a cost thereof in terms of the manufacturing method of the developing device by combining a rare earth magnetic block, which is configured of the rare earth magnet only upon the primary pole component of the roller, upon a magnetic roller that includes a depression part for a positioning thereupon of the rare earth magnetic block.

In addition, it would be possible to ensure a magnetic force aside from the primary development pole, even with a small magnetic roller, by treating a configuration of a small diameter magnetic roller as a magnetic roller, an axis whereof is integrated thereupon, and maintaining a magnetic volume thereof. A necessity arises thereupon, however, for setting a depth of the depression for positioning the rare earth magnetic block more deeply than a location of a support part thereupon, varying as a diameter of the magnetic roller thereof. Presuming such a structure for the magnetic roller involves a reduction of a size of the depression of the magnetic roller when forming the magnetic roller, resulting in an increased weakness in the support part of the magnetic roller, which may in turn lead to a fracturing of the support part of the magnetic roller either immediately after a formation thereof, when the magnetic roller is assembled and mounted, or when the magnetic roller is actually used. In order to prevent such a fracturing of the support part of the magnetic roller thereupon, a magnetic roller has been proposed that causes the support part of the magnetic roller to incorporate a curvature thereupon, as well as to narrow, in a staged manner, a diameter of the support part of the magnetic roller, starting from a diameter of a trunk portion of the magnetic roller proper; refer to Japanese Patent Application Laid Open No. 2000-114031 for particulars.

FIG. 8 is a front view of a conventional magnetic roller, and FIG. 9 is a diagram depicting a state wherein a resin is fully loaded into a casting mold with respect to a manufacturing of the conventional magnetic roller thereof. With regard to the casting mold of the magnetic roller that forms the conventional magnetic roller thereupon, a component that forms a support part, which includes a curvature upon the depression part thereof, results in an edge, which interferes with the resin being loaded into the casting mold, such as is depicted in FIG. 9. As a consequence thereof, a magnetic roller results that does not include the curvature upon the depression part thereof, or, put another way, a magnetic roller results that includes a component that is in a state wherein the resin is not completely loaded, such as is depicted in FIG. 8. As a consequence thereof, a problem arises, in a manner similar to the conventional magnetic roller thereof, wherein a fracture of the support part thereof occurs as a result of an impact of such as when the shrinkage or the imposition arises upon a joint of the support part and the depression part, which is formed upon a main body portion, with respect to the magnetic roller thereof. In addition, a problem also arises wherein a structure of a casting mold becomes increasingly complicated in order to cause the support part thereof to incorporate the curvature thereupon.

Furthermore, a magnetic roller has been proposed wherein the support part and the primary pole portion is formed in an integrated manner from a hard resinate magnetic material, in order to maintain the magnetic force of the primary pole portion, and another portion of the roller is formed from a soft resinate magnetic material comprising a "C" shape as viewed in a cross-section; refer to Japanese Patent Application Laid Open No. H11-242391 for particulars. When presuming such a configuration of the magnetic roller thereof, however, a problem arises wherein it becomes difficult to maintain the magnetic force upon other than the primary pole portion, as well as wherein the magnetic force or a half value width of the primary pole portion increases to a greater level than is necessary thereupon.

SUMMARY OF THE INVENTION

An object of the present invention is to provide a magnetic roller that is highly resilient, which is configured to prevent a support part of the magnetic roller from being fractured, as a result of an impact, such as when a shrinkage or an imposition arises upon a joint of the support part and a depression part, which is formed upon a main body portion of the magnetic roller thereof, a developer carrier having the magnetic roller, a developing device having the developer carrier, a process cartridge having the developer carrier, and an image forming apparatus having the process cartridge.

In order to accomplish the above object, a magnetic roller according to an embodiment of the present invention includes a cylindrical magnetic field generation part, a cylindrical support part that contacts both ends of the magnetic field generation part, further includes a small diameter than the magnetic field generation part, and which is installed upon a common axis thereof as an axis of the cylindrical support part, and a depression part that is installed upon an obverse surface portion of the cylindrical magnetic field generation part, extends in a direction of the axis of the magnetic field generation part, and wherein a lengthwise magnet formation is inserted.

The cylindrical magnetic field generation part includes a main body portion, which is installed upon a central portion thereof, and a reinforcing portion, which is installed upon both end portions thereof, wherein the depression part is installed across the main body portion of the magnetic field generation part overall, and the reinforcing portion is installed between both ends of the depression part and both ends of the support part.

BRIEF DESCRIPTION OF THE DRAWINGS

FIG. 1 depicts a magnetic roller according to an embodiment of the present invention, wherein

FIG. 2 depicts a magnetic roller according to an embodiment of the present invention, wherein

DETAILED DESCRIPTION OF THE PREFERRED EMBODIMENTS

Preferred embodiments of the present invention will be described in detail hereinafter, with reference to the accompanying drawings.

FIG. 1 and FIG. 3 through FIG. 7 depict a magnetic roller according to an embodiment of the present invention.

Figure 1A:
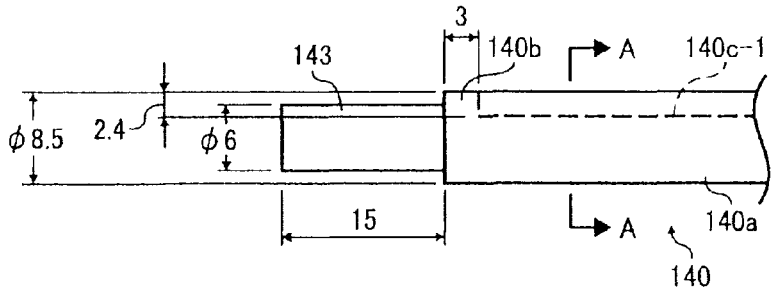
FIG. 1A is a front view thereof, and FIG. 1. B is a cutaway view along a line A-A in FIG. 1A.
Figure 1B:
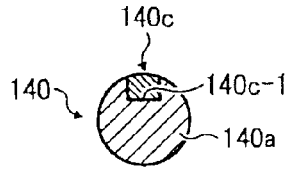

A magnetic roller 133 according to the present invention, such as is shown in FIG. 1, includes a cylindrical magnetic field generation part 140, a cylindrical support part 143 that contacts both of an edge of the magnetic field generation part 140, further includes a smaller diameter than the magnetic field generation part 140, and which is installed upon a common axis thereof as an axis of the cylindrical support part 143, and a depression or groove part 140*c* that is installed upon an obverse surface component of the cylindrical magnetic field generation part 140, extends in a direction of the axis of the magnetic field generation part 140, and wherein a lengthwise magnet formation (not shown) is inserted.

With respect to the magnetic roller 133 according to the present invention, the cylindrical magnetic field generation part 140 includes a main body portion 140*a*, which is installed upon a central portion of the cylindrical magnetic field generation part 140, and a reinforcing portion 140*b*, which is installed upon each of both ends of the cylindrical magnetic field generation part 140, wherein the depression part 140*c* is installed across the main body portion 140*a* of the magnetic field generation part 140 overall, and the reinforcing portion 140*b* is installed between both ends of the depression part 140*c* and both ends of the support part 143.

Thus, with respect to the magnetic roller 133, including the cylindrical magnetic field generation part 140, the cylindrical support part 143 that contacts the both ends of the magnetic field generation part 140, further includes a smaller diameter than that of the magnetic field generation part 140, and which is installed upon a common axis thereof as an axis of the cylindrical support part 143, and a depression part 140*c* that is installed upon the obverse surface component of the cylindrical magnetic field generation part 140, extends in the direction of the axis of the magnetic field generation part 140, and wherein the lengthwise magnet formation (not shown) is inserted, the cylindrical support part 143 is configured of a main body portion 140*a*, which is installed upon a central portion thereof, and a reinforcing portion 140*b*, which is installed upon each of both ends of an edge component thereof.

In this case, the depression part 140*c* is installed across the main body portion 140*a* of the magnetic field generation part 140 overall, the reinforcing portion 140*b* is installed between the both ends of the depression part 140*c* and the both ends of the support part 143, a length in a direction of an axis of a lower surface 140*c*-1 of the depression part 140*c* of the magnetic field generation part 140 is shorter than a length in the direction of the axis of the main body portion 140*a* of the magnetic field generation part 140, the edge portion of the main body portion 140*a* of the magnetic field generation part 140 does not make contact therewith, and, as a consequence thereof, the support part 143 is reinforced with the reinforcing portion 140*b*, which is configured of a vertical cross-section quadrilateral layer, and which is installed between the both ends of the main body portion 140*a* of the magnetic field generation part 140 and the both ends of the depression part 140*c*.

It is possible thereby to provide the magnetic roller 133 that is highly resilient, which prevents a fracturing of the support part 143 thereof as a result of an impact of such as when a shrinkage or an imposition arises upon a joint of the support part 143 of the magnetic roller 133 and the depression part 140*c* thereof, which is installed upon the main body portion 140*a* with respect to the magnetic field generation part 140 of the magnetic roller 133 thereof.

Figure 2A:
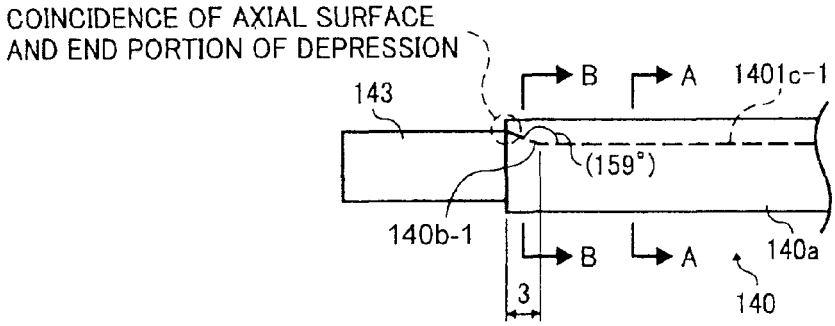
FIG. 2A is a front view thereof, FIG. 2. B is a cutaway view along a line A-A in FIG. 2A, and FIG. 2. C is a cutaway view along a line B-B in FIG. 2A.
Figure 2B:
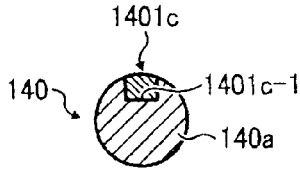
Figure 2C:
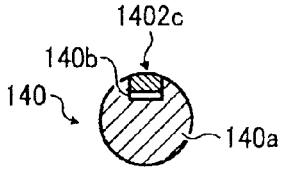

FIG. 2 illustrates a magnetic roller according to another embodiment of the present invention. The magnetic roller 133 according to the present invention, such as is shown in FIG. 2, includes a cylindrical magnetic field generation part 140, a cylindrical support part 143 that contacts the both ends of the magnetic field generation part 140, further has a smaller diameter than the magnetic field generation part 140, and which is installed upon a common axis thereof as an axis of the cylindrical support part 143, and a depression part 140*c*, which includes a first depression part 1401*c* and a second depression part 1402*c* thereof, which is installed upon an obverse surface of the cylindrical magnetic field generation part 140, extends in a direction of the axis of the magnetic field generation part 140.

Here, a lengthwise magnet formation (not shown) is inserted. With respect to the magnetic roller 133, the cylindrical magnetic field generation part 140 includes a main body portion 140*a*, which is installed upon a central portion of the cylindrical magnetic field generation part 140, and a reinforcing portion 140*b*, which is installed upon both ends thereof, wherein the first depression part 1401*c* is installed across the main body portion 140*a* of the magnetic field generation part 140 overall, the reinforcing portion 140*b* is installed between the both ends of the first depression part 1401*c* and the both ends of the support part 143 thereof, a triangular cross-section layer 140*b*−1 being installed upon the reinforcing portion 140*b* thereof, including an incline that is installed from an edge of the reinforcing portion 140*b* that contacts an edge of both of an obverse surface of the support part 143 thereof, to a lower surface 1401*c*−1 of each of the both ends of the first depression part 1401*c*.

Here, an angle that is formed by the incline thereof and a lower surface of the first depression part 1401*c* is presumed to be greater than 90 degrees and less than 180 degrees, and the second depression part 1402*c* is installed upon the incline thereof.

Thus, with respect to the magnetic roller 133, including the cylindrical magnetic field generation part 140, the cylindrical support part 143 that contacts the both ends of the magnetic field generation part 140, further has the smaller diameter than the magnetic field generation part 140, and which is installed upon the common axis thereof as the axis of the cylindrical support part 143, and a depression part 1401*c*, which is configured of a first depression part 1401*c* and a second depression part thereof, which is installed upon an obverse surface of the cylindrical magnetic field generation part 140, extends in a direction of the axis of the magnetic field generation part 140.

Here, a lengthwise magnet formation (not shown) is inserted, the cylindrical magnetic field generation part 140 includes a main body portion 140*a*, which is installed upon a central portion of the cylindrical magnetic field generation part 140, and a reinforcing portion 140*b*, which is installed upon each of both ends thereof.

The first depression part 1401*c* is installed across the main body portion 140*a* of the magnetic field generation part 140 overall, the reinforcing portion 140*b* is installed between both of an edge of the first depression part 1401*c* and both of an edge of the support part 143 thereof, a triangular cross-section layer 140*b*−1 being installed upon the reinforcing portion 140*b* thereof, including an incline that is installed from an edge of the reinforcing portion 140*b* that contacts an edge of both of an obverse surface of the support part 143 thereof, to a lower surface 1401*c*−1 of both of an edge of the first depression part 1401*c*, wherein an angle that is formed by the incline thereof and a lower surface of the first depression part 1401*c* is presumed to be greater than 90 degrees and less than 180 degrees, the second depression part 1402*c* thereof is installed upon the incline thereof, a length in a direction of an axis of a lower surface 1401*c*−1 of the first depression part 1401*c* of the magnetic field generation part 140 is shorter than a length in the direction of the axis of the main body portion 140*a* of the magnetic field generation part 140.

The edge portion of the main body portion 140*a* of the magnetic field generation part 140 does not make contact therewith, and, as a consequence thereof, the support part 143 is reinforced with a vertical cross-section triangular layer 140*b*−1, which, in turn, further includes an incline that is installed between both of an edge portion of the main body portion 140*a* of the magnetic field generation part 140 and both of an edge portion of the first depression part 1401*c*, from the main body portion 140*a* side of the magnetic field generation part 140, which contacts both of the obverse surface of the support part 143, to the lower portion 1401*c*−1 of both of the edge of the first depression part 1401*c*, and it is possible thereby to provide a magnetic roller that is highly resilient, which prevents a fracturing of the support part thereof as a result of an impact of such as when a shrinkage or an imposition arises upon a joint of the support part 143 of the magnetic roller 133 and the first depression part thereof, which is formed upon the main body portion 140*a* with respect to the magnetic field generation part 140 of the magnetic roller 133 thereof.

In addition, an effect as follows is implemented according to the present invention: 1) a rigidity of the magnetic roller 133 increases at time of usage thereof, resulting in a greater resistance to fracturing on the part of the magnetic roller 133 thereof; 2) a depth of the second depression part 1402*c* becomes increasingly shallow as an edge of the second depression part 1402*c* thereof is approached, such that a magnetic block that is positioned upon the lower surface 1401*c*−1 of the second depression part 1402*c* becomes gradually thinner at an edge portion thereof, and, as a consequence thereof, an edge effect thereof is improved; 3) the magnetic field generation part 140 includes a taper, which configures the reinforcing portion 140*b*, i.e., the taper thereof including a triangular cross-section layer 140*b*−1, further including an incline that is installed from an edge of the main body portion 140*a* of the magnetic field generation part 140 thereof that contacts an edge of both of an obverse surface of the support part 143 thereof, to a lower surface 1401*c*−1 of both of an edge of the first depression part 1401*c*, thus simplifying extracting a molded object from a casting mold thereof; and 4) the taper is comprised thereupon in a line with a direction of a flow of a resin within the casting mold thereof, thus interfering with a disruption in the flow of the resin therewithin, and, as a consequence thereof, allowing preventing an incomplete loading of the resin thereby.

According to the application of the present invention, the edge effect refers to a phenomenon wherein a magnetic force of both of an edge portion of either the magnetic block or the magnetic roller increases. As the edge effect increases thereupon, an adsorption force of the developer with respect to both of the edge portion of the magnetic roller increases, a quantity of the developer that is conveyed upon both of the edge portion of the magnetic roller thereof also increases, and, as a consequence thereof, a pressure at an interstice between a development sleeve and a doctor blade grows, resulting in a spillage of the developer thereupon.

According to the present invention, it is preferable for the magnetic field generation part 140 and the support part 143 to be formed as a single unit. The formation thus of the magnetic field generation part 140 and the support part 143 as the single unit thereof results in a more solid joint portion between the magnetic field generation unit 140 and the support part 143 thereof, with the support part 143 being resistant to fracturing as a consequence thereof.

Figure 3:
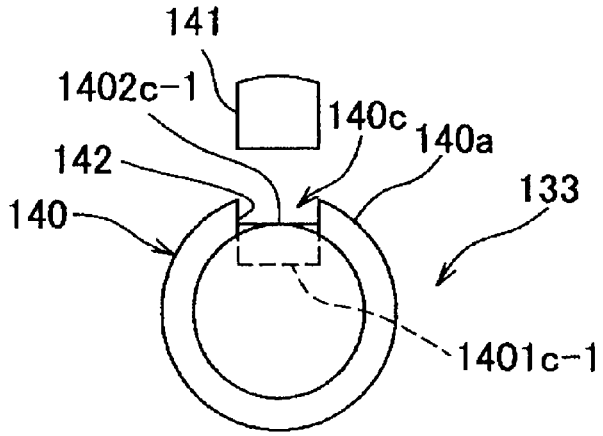
FIG. 3 depicts a state wherein a lengthwise magnet formation is inserted into a depression part of a magnetic roller whereby an embodiment is depicted according to the present invention.

A lengthwise magnet formation 141 is inserted and fixed into a depression part 140*c*, which is formed in a direction of an axis of a magnetic field generation part 140, upon a magnetic roller 133 according to the present invention, such as is depicted in FIG. 3. It is preferable that the lengthwise magnet formation 141 comprise a rare earth magnet block. While the depression part 140*c* is formed in a square bracket shape when viewed in a cross section, it would be permissible for a material (not shown) that is shaped to fit the depression to be pre-inserted upon the depression part 140*c* that is formed in the square bracket shape thereof when viewed in the cross section. Reference numeral 142 is a side wall of the depression part 140*c*.

Figure 6:
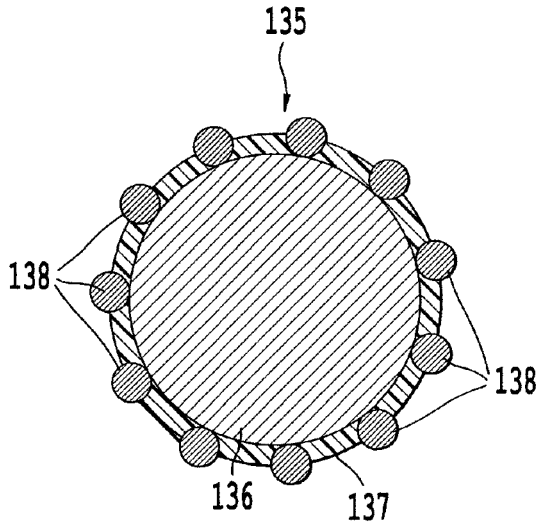
FIG. 6 is a diagram depicting a magnetic carrier.

A developer carrier, i.e., a development roller, 115 according to the present invention includes, at least, a magnetic roller 133, and a non-magnetic cylindrical body, i.e., a development sleeve, 132, which is installed so as to rotate freely upon an outer circumference of the magnetic roller 133 thereof, such as is depicted in FIG. 6. The magnetic roller 133 is installed upon the developer carrier 115. Thus, with regard to the developer carrier 115, which includes, at least, the magnetic roller 133 and the non-magnetic cylindrical body, i.e., the development sleeve, 132, which is installed so as to rotate freely upon the outer circumference of the magnetic roller 133 thereof, it is possible to provide a developer carrier 115 that is highly resilient, avoiding a fracturing of the support part 143 thereof, despite comprising the magnetic roller 133 of the present configuration, and further comprising a small diameter and a strong magnetic force.

Following is a detailed description of a developer carrier, i.e., a development roller, 115, according to the present invention.

Figure 7:
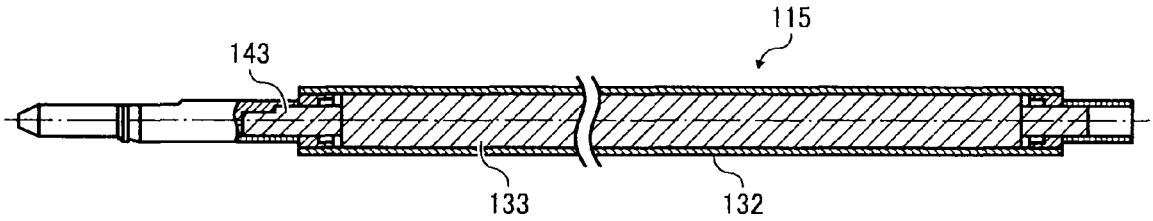
FIG. 7 is a cutaway view according to a line III-III that is depicted in FIG. 5.

A development roller 115 according to the present invention includes a magnetic roller 133 and a development sleeve 132, such as is depicted in FIG. 3 and FIG. 7. The magnetic roller 133 is housed within the development sleeve 132. The magnetic roller 133 includes a cylindrical magnetic field generation part 140, which further includes a depression part 140*c* that is formed in a square bracket shape when viewed in a cross section, and a lengthwise magnet formation, i.e., a rare earth magnet block, 141, which is positioned within the depression part 140*c* thereof, such as is depicted in FIG. 3. It would also be permissible for a material (not shown) that is shaped to fit the depression that is formed in the square bracket shape as viewed in the cross section to be pre-inserted upon the depression part 140*c* that is formed in the brackincludeset shape as viewed in the cross section. Whereas the rare earth magnet block 141 for forming a primary development pole is a magnet block 141 of a rectangular parallelepiped, i.e., a cuboid, shape, that is manufactured by a compressed magnetic field formation process, including a dimension of 2.0 mm in width, 2.4 mm in height, and 313 mm in length, extending in a direction of an axis of the development roller 115 thereof, such as is depicted in FIG. 3, it would also be possible to employ either a plastic magnet or a rubber magnet whereupon is mixed either a rare earth magnet of chiefly a neodymium (Ne) type, including a composition of such as neodymium, iron, and boron (NeFeB), or a samarium (Sm) type, including a composition of such as samarium and cobalt (SmCo) or samarium, iron, and nitrogen (SmFeN), or else a high polymer compound that is mixed with a magnetic particle that is similar thereto, in order to obtain a magnetism characteristic that is both narrow and strong.

Figure 5:
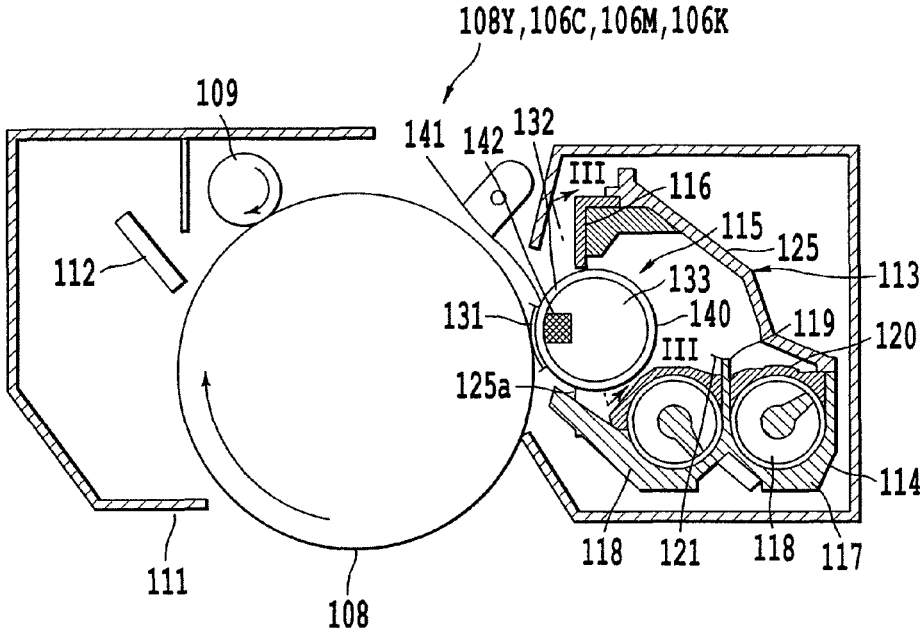
FIG. 5 is a conceptual diagram of a developing device and a process cartridge according to an embodiment of the present invention.

In addition, the cylindrical magnetic field generation part 140 is manufactured in a single unit comprising a magnetic generation portion, i.e., a trunk portion, 140, which forms a magnetism characteristic that is external to the primary development pole, comprising a dimension of 8.5 mm in diameter and 313 mm in length, and a support part 143, comprising a dimension of 6 mm in diameter and 15 mm in length thereupon, such as is depicted in FIG. 5.

A so-called plastic magnet or rubber magnet, wherein a magnetic particle is mixed into a high polymer compound, is frequently employed as a material thereof. It would be permissible to employ either a strontium (Sr)-ferrite compound or a barium (Ba)-ferrite compound as the magnetic particle thereof. In addition, it would be possible to use, as the high polymer compound thereof, either a material of a polyamide (PA) class, such as a PA 6 or a PA 12 thereof, a compound of an ethylene class, such as ethylene ethyl acrylate (EEA) copolymer or ethylene vinyl acrylate (EVA) copolymer, a chlorine material such as chlorinated polyethylene (CPE), or a rubber material such as nitrile butadiene rubber (NBR).

As an instance thereof, a shape of the depression part 140*c*, such as is depicted in FIG. 1, results in a form including a dimension of 2.7 mm in width and 2.4 mm in height, whereas a length of the depression part 140*c* that extends in a direction of an axis thereof would comprise a length wherein a length in a direction of an axis thereof of a lower surface 140*c*−1 of the depression part 140*c* thereof is shorter than a length of a main body portion 140*a*, and moreover, does not make contact with an edge portion of the main body portion 140*a* thereof. A reason for presuming such a shape thereof is to prevent a fracturing of the support part 143 by way of a shrinkage that arises in a joint of the support part 143 and the depression part 140*c* thereupon. It is preferable for an interstice between the edge portion of the lower surface 140*c*−1 of the depression part 140*c* and the main body portion 140*a* to be greater than or equal to 0.75 mm, taking into consideration a reduced thickness by way of an inadequate loading when casting a mold, or a weakness arising from an impact that arises in such as the joint being formed thereupon.

In addition, it is desirable for both of an edge portion of the depression 140*c* to be greater than or equal to 90 degrees with respect to the lower surface 140*c*−1 of the depression part 140*c*, and to be less than or equal to an angle whereby an edge surface of the main body portion 140*a* contacts the support part 143, or, put another way, 159 degrees, such as is shown in FIG. 2. If the angle thereof is less than or equal to 90 degrees, it becomes difficult to extract the casting from the mold. Facilitating preventing the fracturing of the support part 143 arising from the shrinkage that arises in the joint of the support part 143 and the depression part 140*c* causes a depth of the depression to become more shallow as the edge of the depression 140*c* is approached, thus correcting the edge effect thereupon. In addition, the inclusion thereupon of the taper simplifies extracting the casting from the mold, and in addition, the inclusion of the taper in line with the direction of the flow of the resin when the resin is loaded into the mold interferes with the disruption of the flow of the resin thereupon, allowing preventing the inadequate loading of the resin as a result thereof.

The development sleeve 132 is formed from a non-magnetic material, and is installed so as to enclose, i.e., house, the magnetic roller 133, and to rotate freely about a central axis thereof. An inner circumference surface of the development sleeve 132 is made to rotate relative to a sequence of a fixed magnetic pole thereof. The development sleeve 132 is formed from such as aluminum or stainless steel (SUS). Aluminum is superior in terms of workability and weight. When employing aluminum thereupon, it would be preferable to employ A6063, A5056, and A3003. When employing stainless steel (SUS), it would be preferable to employ SUS303, SUS304, and SUS316.

The developing device 113 according to the present invention comprises, at least, a developer carrier, i.e., a development roller, 115, such as is depicted in FIG. 5. With respect to the developing device 113, the developer carrier 115 includes a configuration that is disclosed according to the application of the present invention. With respect to the developing device 113 that comprises, at least, such a developer carrier 115 as is described herein, it would be possible to provide a highly resilient developing device 113 regardless of the developer carrier 115 thereof comprising a narrow diameter and a strong magnetic force.

Each of process cartridges 106Y, 106M, 106C, and 106K according to the present invention includes, at least, a developing device 113, such as is depicted in FIG. 5. With respect to the process cartridges 106Y, 106M, 106C, and 106K thereof, which thus includes, at least, the developing device 113 thereof, it would be possible to provide highly resilient process cartridges 106Y, 106M, 106C, and 106K, when a developing device 113 according to the present invention is comprised thereupon as the developing device 113 thereof.

Figure 4:
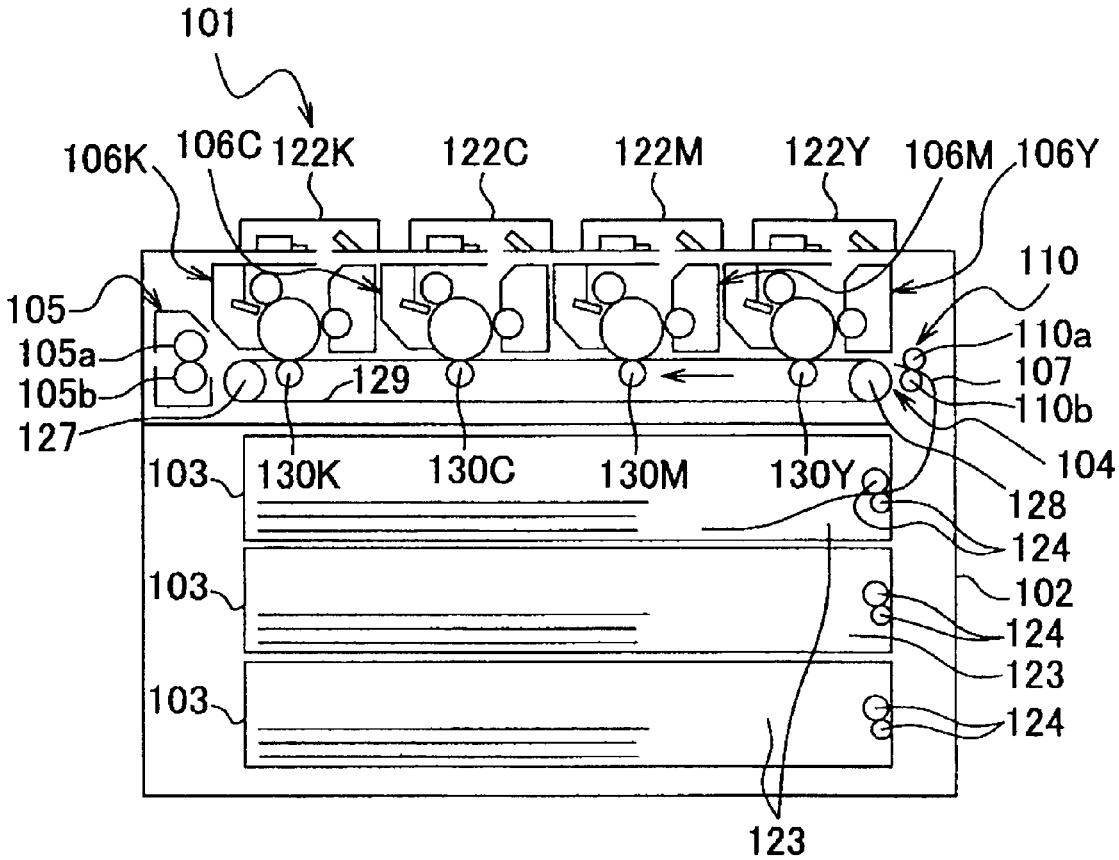
FIG. 4 is a conceptual diagram that depicts an image forming apparatus according to an embodiment of the present invention.

An image forming apparatus 101 according to the present invention includes, at least, process cartridges 106Y, 106M, 106C, and 106K, further including, at least, a developing device 113, such as is depicted in FIG. 4 and FIG. 5. With respect to such an image forming apparatus 101 that thus includes, at least, the process cartridges 106Y, 106M, 106C, and 106K that further includes, at least, the developing device 113, it would be possible to provide a highly resilient image forming apparatus 101 that includes process cartridges 106Y, 106M, 106C, and 106K according to the present invention as the process cartridges 106Y, 106M, 106C, and 106K thereof, regardless of the process cartridges 106Y, 106M, 106C, and 106K thereof including a narrow diameter and a strong magnetic force.

Following is a detailed description of the developing device 113 and the process cartridges 106Y, 106M, 106C, and 106K, according to the present invention.

An image forming apparatus 101 according to the present invention forms an image of each respective color yellow (Y), magenta (M), cyan (C), and black (K), or, put another way, a color image, upon a recording sheet 107 as a single sheet of a transfer material, such as is depicted in FIG. 4 and FIG. 5. It is to be understood that such as a unit that corresponds to each respective color yellow, magenta, cyan, or black will be denoted hereinafter with Y, M, C, and K respectively appended as a suffix to a reference numeral thereof. The image forming apparatus 101 includes, at least, an apparatus body proper 102, a print paper feed unit 103, a pair of resist rollers 110, a transfer unit 104, a fixing unit 105, a plurality of laser writing units 122Y, 122M, 122C, and 122K, and a plurality of process cartridges 106Y, 106M, 106C, and 106K, such as is depicted in FIG. 1.

The apparatus body proper 102 is formed in a box shape, and is installed upon such as a floor, as an instance thereof. The apparatus body proper 102 houses the print paper feed unit 103, the pair of the resist roller 110, the transfer unit 104, the fixing unit 105, the plurality of laser writing units 122Y, 122M, 122C, and 122K, and the plurality of process cartridges 106Y, 106M, 106C, and 106K. A plurality of print paper feed units 103 are installed upon a lower portion of the apparatus body proper 102. Each of the print paper feed units 103 houses a stack of the recording sheet 107, and further includes a print paper feed cartridge 123, which may be freely inserted into, and removed from, the apparatus body proper 102, and a print paper feed roller 124. The print paper feed roller 124 is pressed into contact with an uppermost recording sheet 107 within the print paper feed cartridge 123. The print paper feed roller 124 conveys the uppermost recording sheet 107 thereof between a conveyor belt 129 (to be described hereinafter) of the transfer unit 104 and a photoconductive drum 108 (to be described hereinafter) of a developing device 113 (to be described hereinafter) of each of the process cartridges 106Y, 106M, 106C, and 106K.

The pair of the resist roller 110, which is installed upon a conveyance path of the recording sheet 107 that is conveyed from the print paper feed unit 103 to the transfer unit 104, includes a pair of rollers 110*a* and 110*b*. The pair of resist rollers 110 sandwich the recording sheet 107 between the pair of rollers 110*a* and 110*b*, and convey the recording sheet 107 thus sandwiched between the transfer unit 104 and each of the process cartridges 106Y, 106M, 106C, and 106K, at a timing that allows overlaying each respective toner image thereupon.

The transfer unit 104 is installed upon an upper portion of the print paper feed unit 103. The transfer unit 104 comprises a drive roller 127, a following roller 128, a conveyor belt 129, and a transfer roller 130Y, 130M, 130C, and 130K. The drive roller 127 is positioned upon a downstream side of a direction of a conveyance of the recording sheet 107, and is rotationally driven by such as an electric motor, as a motive power source thereof.

The following roller 128 is supported so as to rotate freely within the apparatus body proper 102, and is positioned upon an upstream side of the direction of the conveyance of the recording sheet 107. The conveyor belt 129 is formed in an endless loop shape, and is suspended upon both the drive roller 127 and the following roller 128. By way of the drive roller 127 being rotationally driven thereupon, the conveyor belt 129 circulates, i.e., travels in an endless loop, in a counterclockwise direction, by way of the rotation of the drive roller 127 and the following roller 128, such as is depicted in FIG. 4.

The transfer rollers 130Y, 130M, 130C, and 130K, respectively, sandwich the conveyor belt 129 and the recording sheet 107 that is conveyed upon the conveyor belt 129 thereof between each of the transfer rollers 130Y, 130M, 130C, and 130K thereof and a photoconductive drum 108 of the process cartridges 106Y, 106M, 106C, and 106K, respectively. Each of the transfer roller 130Y, 130M, 130C, and 130K presses the recording sheet 107, which is conveyed to the transfer unit 104 from the print paper feed unit 103, upon an external obverse surface of the photoconductive drum 108 of each of the process cartridges 106Y, 106M, 106C, and 106K, and the transfer unit 104 thereof transfers the toner image that is formed upon the photoconductive drum 108 thereof to the recording sheet 107 thereupon. The transfer unit 104 conveys the recording sheet 107, whereupon the toner image has been transferred, to the fixing unit 105.

The fixing unit 105, which is installed upon the downstream of the direction of the conveyance of the recording sheet 107 of the transfer unit 104, further comprises a pair of a roller 105*a* and 105*b*, which mutually sandwich the recording sheet 107 thereof therebetween. The fixing unit 105 fixes the toner image that is transferred from the photoconductive drum 108 to the recording sheet 107 by pressure heating the recording sheet 107 thereupon that is conveyed thereto from the transfer unit 104, between the pair of the roller 105*a* and 105*b* thereof. The laser writing units 122Y, 122M, 122C, and 122K are respectively mounted upon an upper portion of the apparatus body proper 102.

The laser writing units 122Y, 122M, 122C, and 122K respectively corresponds to the process cartridges 106Y, 106M, 106C, and 106K. Each of the laser writing units 122Y, 122M, 122C, and 122K projects a laser light upon the external obverse surface of the photoconductive drum 108, which is uniformly charged by a charge roller 109 (to be described hereinafter) of the process cartridge 106Y, 106M, 106C, and 106K, thereby forming an electrostatic latent image thereupon.

The image forming apparatus 101 forms the image upon the recording sheet 107 in a manner such as is depicted hereinafter. First, the image forming apparatus 101 causes the photoconductive drum 108 to rotate, and the external obverse surface of the photoconductive drum 108 is uniformly charged by the charge roller 109. The laser light is projected upon the external obverse surface of the photoconductive drum 108, thereby forming the electrostatic latent image upon the external obverse surface of the photoconductive drum 108 thereof. When the electrostatic latent image is thus located upon a development region 131 thereof, a developer that is adsorbed upon an external obverse surface of a development sleeve 132 of a developing device 113 is in turn adsorbed upon the external obverse surface of the photoconductive drum 108 thereof, whereupon the electrostatic latent image is thus developed, and a toner image is accordingly formed upon the external obverse surface of the photoconductive drum 108 thereof.

The image forming apparatus 101 locates the recording sheet 107, which is conveyed by such as a print paper feed roller 124 of a print paper feed unit 103 thereof, between the photoconductive drum 108 of each of the process cartridges 106Y, 106M, 106C, and 106K and a conveyor belt 129 of a transfer unit 104, and thereby transfers the toner image that is formed upon the external obverse surface of the photoconductive drum 108 thereof to the recording sheet 107 thereupon. The image forming apparatus 101 is configured to fix the toner image upon the recording sheet 107 with a fixing unit 105. Thus, the image forming apparatus 101 form the color image upon the recording sheet 107.

Each of the process cartridges 106Y, 106M, 106C, and 106K according to the present invention is respectively installed between the transfer unit 104 and each of the laser writing units 122Y, 122M, 122C, and 122K. It is possible to freely install and remove the process cartridges 106Y, 106M, 106C, and 106K within the apparatus body proper 102. Each of the process cartridges 106Y, 106M, 106C, and 106K is respectively installed in parallel in line with the direction of the conveyance of the recording sheet 107 thereupon.

The process cartridges 106Y, 106M, 106C, and 106K include a cartridge case 111, a charge roller 109 as a charging device, a photoconductive drum 108 as an electrostatic latent image carrier, a cleaning blade 112 as a cleaning device, and a developing device 113, such as is depicted in FIG. 2. As a consequence thereof, the image forming apparatus 101 includes, at least, the charge roller 109, the photoconductive drum 108, the cleaning blade 112, and the developing device 113. It is possible to freely install and remove the cartridge case 111 within the apparatus body proper 102, and the cartridge case 111 thereof houses the charge roller 109, the photoconductive drum 108, the cleaning blade 112, and the developing device 113.

The charge roller 109 uniformly charges an external obverse surface of the photoconductive drum 108. The photoconductive drum 108 is positioned such that an interstice is provided between the photoconductive drum 108 thereof and a development roller 115 (to be described hereinafter) of the developing device 113. The photoconductive drum 108 is formed upon a cylinder or a tube that is capable of rotating freely about a center axis thereupon. The electrostatic latent image is formed upon the external obverse surface of the photoconductive drum 108 by way of the laser writing units 122Y, 122M, 122C, and 122K that corresponds thereto. The photoconductive drum 108 adsorbs the toner upon the electrostatic latent image that is formed upon and supported by the external obverse surface thereof, thereby developing the electrostatic latent image thereupon.

The toner image thereby obtained is transferred to the recording sheet 107 that is located between the photoconductive drum 108 and the conveyor belt 129. After the toner image is transferred thereby to the recording sheet 107, the cleaning blade 112 removes a post transfer toner that is left upon the external obverse surface of the photoconductive drum 108.

The developing device 113 according to the present invention includes at least, a developer supply portion 114, a case 125, a development roller 115 as a magnetic particle support body, and a developer regulation blade 116 as a developer regulation material, such as is depicted in FIG. 5. The developer supply portion 114 comprises a housing chamber 117 and a pair of a mixing screw 118. The housing chamber 117 is formed in a box shape that is approximately as long as the photoconductive drum 108. In addition, a partition 119 is installed within the housing chamber 117, extending in a direction of a length of the housing chamber 117 thereof. The partition 119 divides an interior of the housing chamber 117 into a first space 120 and a second space 121.

In addition, both of an edge portion of the first space 120 and the second space 121 mutually communicate therewith. The housing chamber 117 houses the developer within both the first space 120 and the second space 121 thereof.

The developer contains a toner and a magnetic carrier 135. The toner is supplied as appropriate to a single edge portion of the first space 120 that is upon a side that is separated from the development roller 115, from between the first space 120 and the second space 121 thereof. The toner is a spherical particle that is manufactured from either an emulsion polymerization method or a suspension polymerization method. It is to be understood that it would also be permissible for the toner to be obtained by pulverizing a mass that is configured of a synthetic resin wherein a wide range of dyes or cosmetics are mixed and dispersed. An average particle diameter of the toner is greater than or equal to 3 μm and less than or equal to 7 μm. In addition, it would also be permissible for the toner to be formed by such as a pulverization process. The magnetic carrier 135 is housed within both of the first space 120 and the second space 121. An average particle diameter of the magnetic carrier 135 is greater than or equal to 20 μm and less than or equal to 50 μm. The magnetic carrier 135 comprises a core material 136, a resin coating film 137 that encases an external obverse surface of the core material 136 thereof, and an aluminum particle 138 that is dispersed upon the resin coating film 137 thereof, such as is depicted in FIG. 6.

The core material 136 is configured of a ferrite material as a magnetic material, and is also formed in a spherical shape thereupon. The resin coating film 137 completely encases the external obverse surface of the core material 136 thereof. The resin coating film 137 includes a resin compound that causes a bridge to be formed between a thermoplastic resin, such as an acrylic, and a melamine resin, and a charge regulator solution. The resin coating film 137 has elasticity and a high adhesive strength.

The aluminum particle 138 is formed in a spherical shape comprising an external diameter that is larger than a thickness of the resin coating film 137. The aluminum particle 138 is maintained with the high adhesive strength of the resin coating film 137. The aluminum particle 138 protrudes into an external circumference side of the magnetic carrier 135 by way of the resin coating film 137.

The mixing screw 118 is respectively housed within the first space 120 and the second space 121. A lengthwise direction of the mixing screw 118 is parallel to the lengthwise direction of the housing chamber 117, the development roller 115, and the photoconductive drum 108. The mixing screw 118 is installed so as to rotate freely in a direction of a central axis thereof, and rotates thereby in the direction of the central axis thereof, thereby mixing the toner and the magnetic carrier 135, as well as conveying the developer thereof in a line with the central axis thereupon. According to the embodiment depicted in the attached drawings, the mixing screw 118 that is housed within the first space 120 conveys the developer from the single edge portion thereof to another edge portion thereof. The mixing screw 118 that is housed within the second space 121 conveys the developer from the other edge portion thereof to the single edge portion thereof.

According to the configuration described herein, the developer supply portion 114 conveys the toner that has been supplied to the single edge portion of the first space 120 to the other edge portion thereof, and conveys the toner thus supplied to the other edge portion of the second space 121, while mixing the toner with the magnetic carrier 135. Thus, the developer supply portion 114 mixes the toner with the magnetic carrier 135 within the second space 121, and supplies the toner thus mixed to the external obverse surface of the development roller 115, while conveying the toner thereof along the direction of the central axis thereupon.

The case 125 is shaped in a box shape, is mounted within the housing chamber 117 of the developer supply portion 114, and encompasses such as the development roller 115, together with the housing chamber 117. In addition, an aperture portion 125*a* is installed upon a portion that is relative to the photoconductive drum 108 of the case 125 thereof.

The development roller 115 is formed in a cylindrical shape, and is installed both in between the second space 121 and the photoconductive drum 108, as well as in a close proximity to the aperture portion 125*a*. The development roller 115 is in a parallel with the photoconductive drum 108 and the housing chamber 117. The development roller 115 is positioned such that an interstice is formed between the development roller 115 and the photoconductive drum 108. The developer regulation blade 116 is installed upon an edge portion of the photoconductive drum 108 of the developing device 113 that is closest thereto. The developer regulation blade 116 is mounted upon the case 125 in a state wherein an interstice is formed between the developer regulation blade 116 and the external obverse surface of the development sleeve 132. The developer regulation blade 116 shaves off, into the housing chamber 117, the developer upon the external obverse surface of the development sleeve 132 that exceeds a prescribed thickness, thereby maintaining the developer upon the external obverse surface of the development sleeve 132, which is conveyed to the development region 131, at the prescribed thickness thereof.

The developing device 113 sufficiently mixes the toner and the magnetic carrier 135 in the developer supply portion 114, and causes the developer thus mixed to be adsorbed upon the external obverse surface of the development sleeve 132, by way of a fixed magnetic pole. Thus, the developing device 113 thereof conveys the developer thus adsorbed by a plurality of the fixed magnetic pole thereof by the rotation therein of the development sleeve 132 toward the development region 131. The developing device 113 causes the developer that is maintained at the prescribed thickness with the developer regulation blade 116 to be adsorbed upon the photoconductive drum 108. Thus, the developing device 113 supports the developer upon the development roller 115, conveys the developer toward the development region 131, develops the electrostatic latent image upon the photoconductive drum 108, and forms the toner image thereby. The developing device 113 causes the developer that has thus been used in the development of the toner image thereof to separate in a direction of the housing chamber 117. The developer that has thus been used in the development of the toner image thereof, and is thus housed within the housing chamber 117, is once more mixed sufficiently with another developer within the second space 121, and is employed again in the development of the electrostatic latent image of the photoconductive drum 108.

First Example

1. Presuming a magnetic roller, including a depression part in a direction of an axis thereof, which is formed by an injection molding while impressing a 0.6 tesla (T) magnetic field at a resin temperature of 300 degrees C. unidirectionally, directly vertically with respect to a lower surface of a depression part, employing a compound of anisotropic strontium (Sr) ferrite and 12 PA (manufactured by Toda Kogyo Corp.) and by performing a demagnetization by impressing a 0.1 tesla (T) magnetic field in a direction that is opposite to the direction of the magnetic field that is impressed at the time of the injection thereupon, a magnetic field generation part thereby includes an external diameter of a main body portion thereof of ϕ8.5 mm, a total length of 313 mm, a width of 2.7 mm, a height of 2.4 mm, and an interstice of 3 mm between an edge portion of the lower surface of the depression part and the main body portion of the magnetic field generation part, as well as a depression part wherein both of an edge portion of the depression part thereof forms a 90 degree angle with respect to the lower surface of the depression part thereof, an integrated magnetic roller including a support part further having an external diameter of 6 mm and a length of 15 mm is obtained; refer to FIG. 1.

2. A load 2N is suspended upon the magnetic roller that is obtained by a method such as is described herein upon a location that is 13 mm upon a side of the support part from a joint of the main body portion and the support part thereof, as a support point within 2 mm from both of an edge portion of the main body portion on a side thereof that is opposite to the depression part thereof. In the present circumstance, the load 2N that is thus suspended therefrom is approximately 1.2N in a circumstance wherein a magnetic attraction upon an upstream region of a doctor is a high stress, i.e., a magnetic flux density at a doctor pole of 60 millitesla (mT), which causes a developing roller to bend, and the 2N is selected as a load value that allows a margin thereupon. In such a circumstance, testing a fracture state among 10 samples thereof resulted in no fracture being noticed upon the support part of any of the samples thereof.

Second Example

With regard to the first instance 1 according to the first example, wherein it is presumed that the magnetic field generation part includes a depression shape thereof, further having a width of 2.7 mm, a height of 2.4 mm, and an interstice of 3 mm between an edge portion of a lower portion of the depression part thereof and an edge portion of the main body portion, and further includes a depression part that further has a 159 degree angle, i.e., an angle wherein the edge portion of the main body portion contacts the axis thereof, between both of the edge portion of the depression and the low surface of the depression thereof, the magnetic roller is obtained in a manner otherwise similar to the manner according to the first embodiment; refer to FIG. 2. Treating the magnetic roller obtained by the method described herein in a manner similar to the second instance 2 according to the first example, testing a fracture state of the support part thereof resulted in no fracture being noticed upon the support part of any of the samples thereof.

Third Example

With regard to the first instance 1 according to the first example, wherein it is presumed that the magnetic field generation part includes a depression shape thereof, further having a width of 2.7 mm, a height of 2.4 mm, and an interstice of 0.75 mm between an edge portion of a lower portion of the depression part thereof and an edge portion of a trunk portion, and further includes a depression part that further has a 90 degree angle, i.e., an angle wherein the edge portion of the main body portion contacts the axis thereof, between both of the edge portion of the depression and the low surface of the depression thereof, the magnetic roller is obtained in a manner otherwise similar to the manner according to the first example. Treating the magnetic roller obtained by the method described herein in a manner similar to the second instance 2 according to the first example, testing a fracture state of the support part thereof resulted in no fracture being noticed upon the support part of any of the samples thereof.

Fourth Example

With regard to the first instance 1 according to the first example, wherein it is presumed that the magnetic field generation part includes a depression shape thereof, further having a width of 2.7 mm, a height of 2.4 mm, and an interstice of 0.75 mm between an edge portion of a lower portion of the depression part thereof and an edge portion of the trunk portion, and further includes a depression part that further comprises a 124 degree angle, i.e., an angle wherein the edge portion of the main body portion contacts the axis thereof, between both of the edge portion of the depression and the low surface of the depression thereof, the magnetic roller is obtained in a manner otherwise similar to the manner according to the first example. Treating the magnetic roller obtained by the method described herein in a manner similar to the second instance 2 according to the first example, testing a fracture state of the support part thereof resulted in no fracture being noticed upon the support part of any of the samples thereof.

First Comparative Example

Figure 8A:
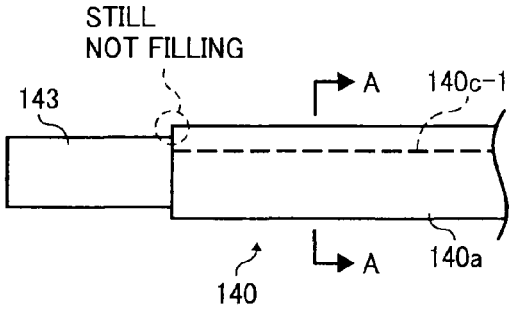
FIG. 8A Background Art
FIG. 8A is a cutaway view of a conventional magnetic roller and FIG. 8B is a front view of a conventional magnetic roller.
Figure 8B:
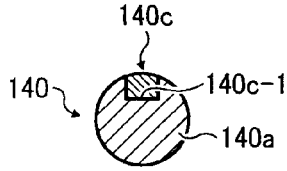
FIG. 8B Background Art
Figure 9:
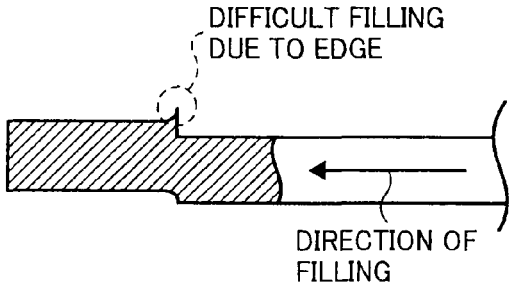
FIG. 9 Background Art
FIG. 9 is a diagram that depicts a state of loading a resin upon a casting mold with respect to manufacturing a conventional magnetic roller.

With regard to the first instance 1 according to the first example, wherein it is presumed that the magnetic field generation part includes a depression shape thereof, further having a width of 2.7 mm, a height of 2.4 mm, and a state of contact between an edge portion of a lower portion of the depression part thereof and an edge portion of the main body portion, the magnetic roller is obtained in a manner otherwise similar to the manner according to the first example; refer to FIG. 8. Treating the magnetic roller obtained by the method described herein in a manner similar to the second instance 2 according to the first example, testing a fracture state of the support part thereof resulted in a fracture being noticed upon the support part of all of the samples thereof.

Second Comparative Example

With regard to the first instance 1 according to the first example, wherein it is presumed that the magnetic field generation part includes a depression shape thereof, further having a width of 2.7 mm, a height of 2.4 mm, and a state of contact between an edge portion of a lower portion of the depression part thereof and an edge portion of the main body portion, and furthermore presuming that a support part is formed thereupon, having a diameter of 6 mm by way of a curve with a radius of curvature of 2 mm from the edge portion of the main body portion thereof, the magnetic roller is obtained in a manner otherwise similar to the manner according to the first example; refer to FIG. 8. Treating the magnetic roller obtained by the method described herein in a manner similar to the second instance 2 according to the first example, testing a fracture state of the support part thereof resulted in a fracture being noticed upon the support part of all of the samples thereof.

According to the present invention, it is possible to provide a highly resilient magnetic roller that prevents a fracturing of a support part thereof as a result of an impact of such as when a shrinkage or an imposition arises upon a joint of the support part and a depression part, which is formed upon a main body portion with respect to a magnetic field generation part of the magnetic roller thereof. The magnetic roller includes a cylindrical magnetic field generation part, a cylindrical support part that contacts both of an edge of the magnetic field generation part, further includes a smaller diameter than the magnetic field generation part, and which is installed upon a common axis thereof as an axis of the cylindrical support part, and a depression part that is installed upon an obverse surface component of the cylindrical magnetic field generation part, extends in a direction of the axis of the magnetic field generation part.

A lengthwise magnet formation is inserted, wherein the cylindrical magnetic field generation part is configured of a main body portion, which is installed upon a central portion thereof, and a reinforcing portion, which is installed upon both of an edge component thereof, wherein the depression part is installed across the main body portion of the magnetic field generation part overall, and the reinforcing portion is installed between both of an edge of the depression part and both of an edge of the support part, a length in a direction of an axis of a lower surface of the depression part of the magnetic field generation part is shorter than a length in the direction of the axis of the main body portion of the magnetic field generation part, the edge portion of the main body portion of the magnetic field generation part does not make contact therewith, and, as a consequence thereof, the support part is reinforced with the reinforcing portion, which is configured of a vertical cross-section quadrilateral layer, and which is installed between both of an edge portion of the main body portion of the magnetic field generation part and both of an edge portion of the depression part.

In addition, it is possible to provide a highly resilient magnetic roller that prevents a fracturing of a support part thereof as a result of an impact of such as when a shrinkage or an imposition arises upon a joint of a support part and a first depression part of a depression part, which is formed upon a main body portion with respect to a magnetic field generation part of the magnetic roller thereof.

The magnetic roller according to the present invention includes a cylindrical magnetic field generation part, a cylindrical support part that contacts both of an edge of the magnetic field generation part, further has a smaller diameter than the magnetic field generation part, and which is installed upon a common axis thereof as an axis of the cylindrical support part, and a depression part, which is configured of a first depression part and a second depression part thereof, installed upon an obverse surface component of the cylindrical magnetic field generation part, extends in a direction of the axis of the magnetic field generation part.

A lengthwise magnet formation (not shown) is inserted, wherein the cylindrical magnetic field generation part is configured of a main body portion, which is installed upon a central portion of the cylindrical magnetic field generation part, and a reinforcing portion, which is installed upon both of an edge component thereof, wherein the first depression part is installed across the main body portion of the magnetic field generation part overall, the reinforcing portion is installed between both of an edge of the first depression part and both of an edge of the support part thereof.

A triangular cross-section layer being installed upon the reinforcing portion thereof, includes an incline that is installed from an edge of the reinforcing portion that contacts an edge of both of an obverse surface of the support part thereof, to a lower surface of both of an edge of the first depression part, wherein an angle that is formed by the incline thereof and a lower surface of the first depression part is presumed to be greater than 90 degrees and less than 180 degrees.

The second depression part is installed upon the incline thereof, a length in a direction of an axis of a lower surface of the first depression part of the magnetic field generation part is shorter than a length in the direction of the axis of the main body portion of the magnetic field generation part, the edge portion of the main body portion of the magnetic field generation part does not make contact therewith, and, as a consequence thereof, the support part is reinforced with a vertical cross-section triangular layer, which, in turn, further includes an incline that is installed between an edge portion side of the main body portion of the magnetic field generation part and both of an edge portion of the first depression part, from the main body portion side of the magnetic field generation part, which contacts both of the obverse surface of the support part, to the lower portion of both of the edge of the first depression part.

In addition, an effect as follows is implemented: a rigidity of the magnetic roller increases at time of usage thereof, resulting in a greater resistance to fracturing on the part of the magnetic roller thereof; a depth of the second depression part becomes increasingly shallow as an edge of the second depression part thereof is approached, such that a magnetic block that is positioned upon the lower surface of the second depression part becomes gradually thinner at an edge portion thereof, and, as a consequence thereof, an edge effect thereof is improved; the magnetic field generation part comprises a taper, which configures the reinforcing portion, thus simplifying extracting a molded object from a casting mold thereof; and the taper is comprised thereupon in a line with a direction of a flow of a resin within the casting mold thereof, thus interfering with a disruption in the flow of the resin therewithin, and, as a consequence thereof, allowing preventing an incomplete loading of the resin thereby.

A formation of the magnetic field generation part and the support part as a single unit thereof results in a more solid joint portion between the magnetic field generation unit and the support part thereof, with the support part being resistant to fracturing as a consequence thereof.

With regard to a developer carrier, which includes, at least a magnetic roller and a non-magnetic cylindrical body, which is installed so as to rotate freely upon the outer circumference of the magnetic roller thereof, it is possible to provide a developer carrier that is highly resilient, avoiding a fracturing of the support part thereof, despite including the magnetic roller and further including a small diameter and a strong magnetic force.

With respect to the developing device that comprises, at least a developer carrier as is described herein, a developer carrier, further comprising the configuration thereof described herein, is comprised thereupon as the developer carrier thereof, it would be possible to provide a highly resilient developing device regardless of the developer carrier thereof comprising a narrow diameter and a strong magnetic force as the developer carrier thereof.

With respect to a process cartridge that includes, at least a developing device, it would be possible to provide a highly resilient process cartridge, regardless of the process cartridge thereof comprising a narrow diameter and a strong magnetic force, by way of the process cartridge comprising a magnetic roller whereupon a support part thereof does not fracture.

With regard to an image forming apparatus that comprises, at least a process cartridge that further comprises, at least a developing device, the image forming apparatus comprises a process cartridge that further comprises the configuration described herein, and thus, it would be possible to provide a highly resilient image forming apparatus, regardless of the image forming apparatus thereof comprising a narrow diameter and a strong magnetic force, by way of the image forming apparatus comprising a magnetic roller whereupon a support part thereof does not fracture.

Although the preferred embodiments of the present invention have been described, it should be understood that the present invention is not limited to these embodiments, and various modifications and changes may be made to the embodiments.

What is claimed is:

1. A magnetic roller, comprising:

a cylindrical magnetic field generation part;

a cylindrical support part configured to contact each of both ends of the cylindrical magnetic field generation part, and having a smaller diameter than the cylindrical magnetic field generation part, and to be installed upon a common axis thereof as an axis of the cylindrical support part; and a depression part, including a first depression part and a second depression part thereof, to be installed upon an obverse surface component of the cylindrical magnetic field generation part, to extend in a direction of the axis of the cylindrical magnetic field generation part, and wherein a lengthwise magnet formation is to be inserted;

wherein the cylindrical magnetic field generation part includes a main body portion, which is installed upon a central portion of the cylindrical magnetic field generation part, and a reinforcing portion, which is installed upon each of both ends of the cylindrical magnetic field generation part;

wherein the first depression part is installed across the main body portion of the cylindrical magnetic field generation part overall;

the reinforcing portion is installed between an end of the first depression part and an end of a support part thereof;

wherein a triangular cross-section layer is installed upon the reinforcing portion thereof, the triangular cross-section layer having an incline configured to be installed from an edge of the reinforcing portion that contacts an edge of an obverse surface of a support part thereof, to a lower surface of both of an edge of the first depression part, wherein an angle that is formed by the incline thereof and a lower surface of the first depression part is presumed to be greater than 90 degrees and less than 180 degrees; and the second depression part thereof is installed upon the incline thereof.

2. The magnetic roller according to claim 1, wherein:

the cylindrical magnetic field generation part and the support part are formed as a single unit.

3. A developer carrier, comprising:

a magnetic roller including a cylindrical magnetic field generation part;

a cylindrical support part configured to contact each of both ends of the cylindrical magnetic field generation part, and having a smaller diameter than the cylindrical magnetic field generation part, and to be installed upon a common axis thereof as an axis of the cylindrical support part; and a depression part, including a first depression part and a second depression part thereof, to be installed upon an obverse surface component of the cylindrical magnetic field generation part, to extend in a direction of the axis of the cylindrical magnetic field generation part, and wherein a lengthwise magnet formation is to be inserted;

wherein the cylindrical magnetic field generation part includes a main body portion, which is installed upon a central portion of the cylindrical magnetic field generation part, and a reinforcing portion, which is installed upon each both ends of the cylindrical magnetic field generation part;

wherein the first depression part is installed across the main body portion of the cylindrical magnetic field generation part overall;

the reinforcing portion is installed between an end of the first depression part and an end of a support part thereof;

wherein a triangular cross-section layer is installed upon the reinforcing portion thereof, the triangular cross-section layer having an incline configured to be installed from an edge of the reinforcing portion that contacts an edge of an obverse surface of a support part thereof, to a lower surface of both of an edge of the first depression part, wherein an angle that is formed by the incline thereof and a lower surface of the first depression part is presumed to be greater than 90 degrees and less than 180 degrees; and the second depression part thereof is installed upon the incline thereof; and a non-magnetic cylindrical body configured to be rotatably mounted upon an external circumference of the magnetic roller.

4. The developer carrier according to claim 3, wherein the developer carrier is included in a developing device.

5. The developer carrier according to claim 4, wherein the developing device is included in a process cartridge.

6. An image forming apparatus, comprising:

a process cartridge including a developing device, the developing device including a developer carrier, the developer carrier including a magnetic roller and a non-magnetic cylindrical body configured to be rotatably mounted upon an external circumference of the magnetic roller, the magnetic roller including a cylindrical magnetic field generation part;

a cylindrical support part configured to contact each of both ends of the cylindrical magnetic field generation part, and having a smaller diameter than the cylindrical magnetic field generation part, and to be installed upon a common axis thereof as an axis of the cylindrical support part; and a depression part, including a first depression part and a second depression part thereof, to be installed upon an obverse surface component of the cylindrical magnetic field generation part, to extend in a direction of the axis of the cylindrical magnetic field generation part, and wherein a lengthwise magnet formation is to be inserted;

wherein the cylindrical magnetic field generation part includes a main body portion, which is installed upon a central portion of the cylindrical magnetic field generation part, and a reinforcing portion, which is installed upon each both ends of the cylindrical magnetic field generation part;

wherein the first depression part is installed across the main body portion of the cylindrical magnetic field generation part overall;

the reinforcing portion is installed between an end of the first depression part and an end of a support part thereof;

wherein a triangular cross-section layer is installed upon the reinforcing portion thereof, the triangular cross-section layer having an incline configured to be installed from an edge of the reinforcing portion that contacts an edge of an obverse surface of a support part thereof, to a lower surface of both of an edge of the first depression part, wherein an angle that is formed by the incline thereof and a lower surface of the first depression part is presumed to be greater than 90 degrees and less than 180 degrees; and the second depression part thereof is installed upon the incline thereof.

* * * * *